US007328500B2

(12) United States Patent
Kim et al.

(10) Patent No.: US 7,328,500 B2
(45) Date of Patent: Feb. 12, 2008

(54) METHOD OF MANUFACTURING LAMINATED POLAR ANISOTROPIC HYBRID MAGNET

(75) Inventors: Sang-Myun Kim, Cheongju-si (KR); Dong-Hwan Kim, Cheongju-si (KR)

(73) Assignee: Jahwa Electronics Co., Ltd. (KR)

( * ) Notice: Subject to any disclaimer, the term of this patent is extended or adjusted under 35 U.S.C. 154(b) by 612 days.

(21) Appl. No.: 10/834,302

(22) Filed: Apr. 28, 2004

(65) Prior Publication Data

US 2005/0034788 A1 Feb. 17, 2005

(30) Foreign Application Priority Data

Aug. 13, 2003 (KR) ..... 10-2003-0056047

(51) Int. Cl.
*H01F 3/08* (2006.01)

(52) U.S. Cl. ..... 29/609; 29/608; 148/104

(58) Field of Classification Search ..... None
See application file for complete search history.

(56) References Cited

U.S. PATENT DOCUMENTS 5,145,614 A * 9/1992 Kuroda ..... 264/429
6,421,519 B1 * 7/2002 Yamashita et al. ..... 399/277

FOREIGN PATENT DOCUMENTS

JP 2000-195714 * 7/2000
WO WO 91/01562 * 2/1991

* cited by examiner

*Primary Examiner*—John P Sheehan
(74) *Attorney, Agent, or Firm*—Daniel P. Burke & Associates, PLLC

(57) ABSTRACT

Disclosed is a method of manufacturing a laminated polar anisotropic hybrid magnet, which includes separately mixing first permanent magnet powders having low magnetic properties and second permanent magnet powders having high magnetic properties with a thermoplastic resin to prepare first and second compound pellets, respectively, and firstly injecting the first compound pellets by use of a first injection mold, to prepare a polar anisotropic and anisotropic resin magnet, which is then placed into a second injection mold having an outer diameter lager than that of the first mold, followed by secondly injecting in a magnetic field together with the second compound pellets. The manufacturing method of the current invention is advantageous in terms of exhibition of higher magnetic properties of the laminated polar anisotropic hybrid magnet, and reduction of the use of expensive materials, thus generating economic benefits. Further, a flux density wave of the magnet can be easily controlled on the magnet surface to be suitable for performances and characteristics of the motors, and temperature properties of the magnet can be enhanced. Thereby, the entire manufacturing method can be efficiently carried out, therefore increasing productivity and reliability in practical use thereof.

13 Claims, 12 Drawing Sheets

METHOD OF MANUFACTURING LAMINATED POLAR ANISOTROPIC HYBRID MAGNET

BACKGROUND OF THE INVENTION

1. Field of the Invention

The present invention relates, in general, to manufacturing methods of laminated polar anisotropic hybrid magnets having higher magnetic properties than those of conventional anisotropic injected magnets, which can reduce the use of expensive magnet materials. More specifically, the present invention relates to a method of manufacturing a laminated polar anisotropic hybrid magnet, characterized in that an inexpensive permanent magnet powder having low magnetic properties and an expensive permanent magnet powder having high magnetic properties are separately mixed with a thermoplastic resin, after which first and second injection molding processes are sequentially performed in a magnetic field by use of polar anisotropic molds having different outer diameters. In such cases, as for manufacturing a ring-type anisotropic bonded magnet by means of an injection molding process or a compression molding process, the permanent magnet materials are layered and hybridized using magnetic circuit design technique, whereby the above anisotropic bonded magnet can be economically increased in magnetic properties, and has magnetic flux density waves controllable on the magnet surface to obtain flux density waves suitable for performances and characteristics of motors, with enhanced temperature properties. Hence, the manufacturing method of the laminated polar anisotropic hybrid magnet of the present invention is efficiently improved, resulting in increased productivity and reliability in practical use thereof.

2. Description of the Related Art

In recent years, permanent magnets having high magnetic properties are increasingly required to be manufactured, according to development of design techniques for products, such as motors, actuators, or medical instruments, as well as miniaturization and high functionality of constitutive parts and materials used for such products.

The permanent magnets having high magnetic properties are mainly applicable for high-powered motor products, for example, VCRs, laser printers, hard disk drives (HDD), robots, electric power steering, automobile fuel pumps, washing machines, refrigerators, air conditioners, etc. As such, high magnetic properties of the permanent magnet result in variously changeable motor design techniques and wide applications thereof. Further, the sizes of end products can be decreased, and thus, manufacturing costs thereof are lowered. Additionally, by utilizing motors having high efficiencies, energy saving of end products can be expected. Thus, main research for permanent magnets intends to develop a permanent magnet material having high energy product, or to maximize a surface flux density of the permanent magnet by optimizing the magnetic circuit designs even though the same permanent magnet material is used.

Although the former research requires high material costs for the development of the magnet materials, the latter research may economically be undergoing because the magnetic properties may increase by means of only the magnetic circuit design technique.

Typically, conventional methods of manufacturing a ring-type anisotropic bonded magnet are classified into an injection molding process, and a compression molding process.

As for the injection molding process, permanent magnet powders for the bonded magnet, such as ferrite powders, alnico powders, Sm—Co powders, HDDR (Hydrogen Disproportionation Desorption Recombination)-treated Nd—Fe—B powders, Sm—Fe—N powders, etc., are mixed with a thermoplastic resin (e.g., nylon) at 150-300° C. in an atmosphere or inert gas, to prepare a compound, which is further heated at 150-300° C. to have flowability, followed by injection molding by use of a mold having a predetermined cavity which is applied with a magnetic field.

As for the compression molding process, permanent magnet powders for the bonded magnet, such as ferrite powders, alnico powders, Sm—Co powders, HDDR-treated Nd—Fe—B powders, Sm—Fe—N powders, etc., are mixed with a thermosetting resin, for example, epoxy, in the temperature range of room temperature to 100° C. in an atmosphere or inert gas, to prepare a compound, which is then placed into a mold having a predetermined cavity, and thereafter applied with a magnetic field, whereby the compound is oriented in the magnetic field direction and compressed.

In manufacturing the ring-type anisotropic bonded magnet, when the compound is charged in the mold which is applied with the magnetic field by a permanent magnet or an electromagnet, the magnet powders of the compound are oriented in the magnetic field direction. As such, as shown in FIG. 1*a*, a magnetization direction of the magnet is formed in a radial direction (arrow direction) facing outward from the center of the circle. Such a magnet is called a radial magnet 10, which has a surface flux density formed in a saw-toothed wave shape along the circumference of the radial magnet 10.

The radial magnet 10 has excellent magnetic properties and is used to form an integrated ring magnet, thus generating economic benefits, compared to a ring magnet obtained by assembling C-shaped magnet parts. However, since the radial magnet 10 has the surface flux density having a saw-toothed wave shape, a magnetic force between the magnet and the silicon steel plate of the armature in the motor becomes high, therefore causing a cogging phenomenon.

In addition, FIG. 1*b* shows an orientation direction of magnetic field of a polar anisotropic magnet 20 which is distributed in only the outside of the circle. Compared to the radial magnet having the same pole numbers and sizes manufactured by use of the same permanent magnet material, the above polar anisotropic magnet 20 is higher by 30-40% in surface flux density and has a sinusoid suitable for use in the motor. However, the anisotropic magnet 20 is disadvantageous in terms of high manufacturing costs, due to requirement of extra magnet materials for the formation of the magnetic path up to the inner part of the magnet.

With the intention of increasing the magnetic properties (surface flux density) of the ring-type anisotropic bonded magnet, a volume ratio of the magnet powder in the compound increases, or a rare earth powder, such as Sm—Co powder, HDDR-treated Nd—Fe—B powder, Sm—Fe—N powder, etc., is further used. However, the rare earth powder is about 10 times as expensive as the ferrite powder having low magnetic properties. Hence, the rare earth powder is restrictedly utilized in only the motor requiring high characteristics.

Alternatively, to manufacture the ring magnet having desired magnetic properties while reducing material costs, the ferrite powder and the rare earth powder are mixed at a proper ratio upon a compounding process, thereby obtaining a polar anisotropic hybrid magnet 30, as shown in FIG. 2*a*.

Such a polar anisotropic hybrid magnet 30, composed of ferrite and rare earth powders mixed at 50:50 vol %, has a surface flux density in proportion to the volume ratio of the rare earth powder, and hence, it cannot function desirably, thus negating economic benefits (FIG. 2*b*).

Meanwhile, the ring-type anisotropic bonded magnet having high magnetic properties results from the use of the rare earth powder having high magnetic properties, such as HDDR-treated Nd—Fe—B powder, Sm—Fe—N powder, etc. However, coercive force of the above anisotropic bonded magnet drastically decreases at a rate of −0.4 to −0.45%/° C. and −0.4 to −0.42%/° C., according to the temperature increase. Therefore, the above anisotropic bonded magnet is lower in thermal reliability for magnetic performance, compared to a bonded magnet prepared by using the relatively inexpensive ferrite powder (coercive force change: 0.35-0.55%/° C.), and cannot be applied for motors employed at relatively high temperatures.

Consequently, conventional manufacturing methods of the ring-type anisotropic bonded magnet are limited in efficiencies thereof, thus remarkably decreasing productivity and reliability in practical use thereof.

SUMMARY OF THE INVENTION

Therefore, it is an object of the present invention to alleviate the problems of injection molding or compression molding in the related art for manufacturing a ring-type anisotropic bonded magnet, which is applied for high-powered motors and actuators, and to provide a method of manufacturing a laminated polar anisotropic hybrid magnet that has higher magnetic properties than those of conventional anisotropic injected magnets, capable of decreasing the use of expensive magnet materials.

Another object of the present invention is to provide a method of manufacturing a laminated polar anisotropic hybrid magnet which has a controllable flux density wave on the magnet surface to obtain a flux density wave suitable for performances and characteristics of motors and has enhanced temperature properties.

Still another object of the present invention is to provide a method of manufacturing a laminated polar anisotropic hybrid magnet, characterized by increasing manufacturing efficiencies, thus maximizing productivity and reliability in practical use thereof.

To achieve the above objects of the present invention, there is provided a method of manufacturing a laminated polar anisotropic hybrid magnet, as a ring-type anisotropic bonded magnet that results from an injection molding process or a compression molding process and has a layered and hybridized structure of a permanent magnet using magnetic circuit design technique, the method including mixing inexpensive permanent magnet powders having low magnetic properties with a thermoplastic resin to prepare first compound pellets having low magnetic properties, and mixing expensive permanent magnet powders having high magnetic properties with a thermoplastic resin to prepare second compound pellets having high magnetic properties; firstly injecting the first compound pellets by use of a polar anisotropic and anisotropic mold, to prepare a polar anisotropic and anisotropic resin magnet; and placing the polar anisotropic and anisotropic resin magnet into a polar anisotropic mold having an outer diameter lager than that of the polar anisotropic and anisotropic mold, followed by secondly injecting in a magnetic field together with the second compound pellets.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1A:
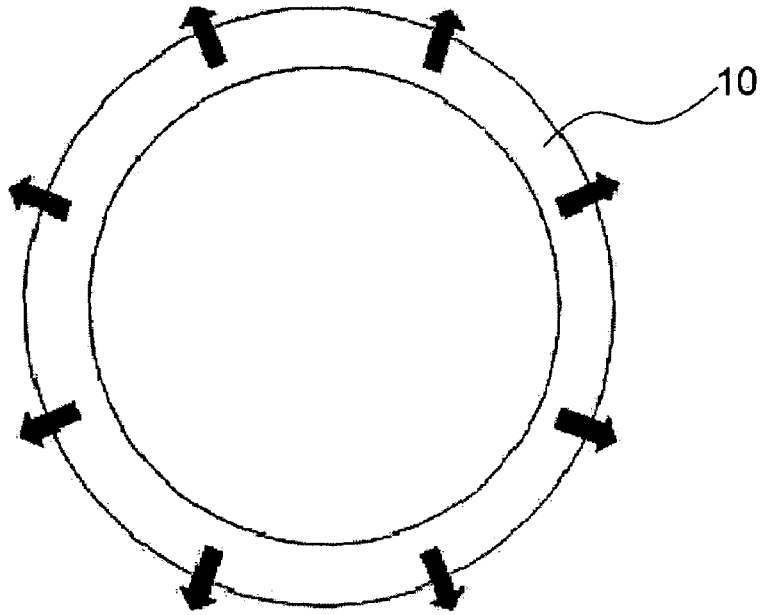
Fig. 1a Prior Art
FIG. 1*a* is a view showing a magnetization direction of a conventional radial magnet.
Figure 1B:
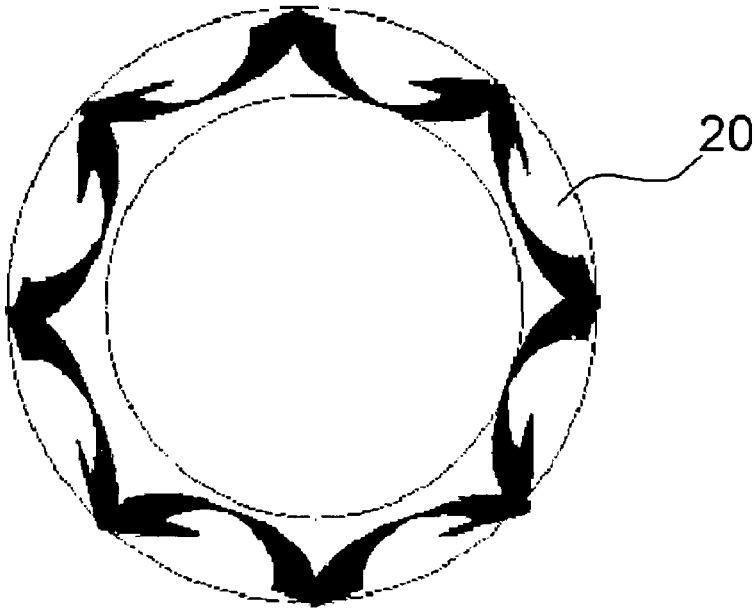
Fig. 1b Prior Art
FIG. 1*b* is a view showing a magnetization direction of a conventional polar anisotropic magnet.
Figure 2A:
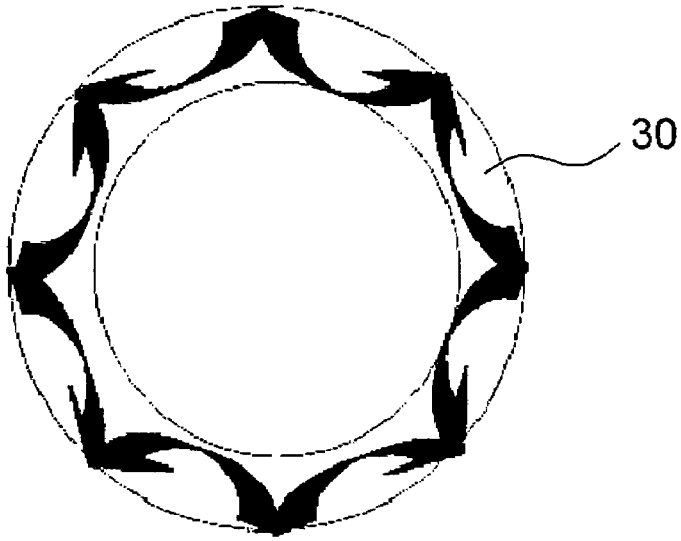
Fig. 2a Prior Art
FIG. 2*a* is a view showing a magnetization direction of a conventional polar anisotropic hybrid magnet.
Figure 2B:
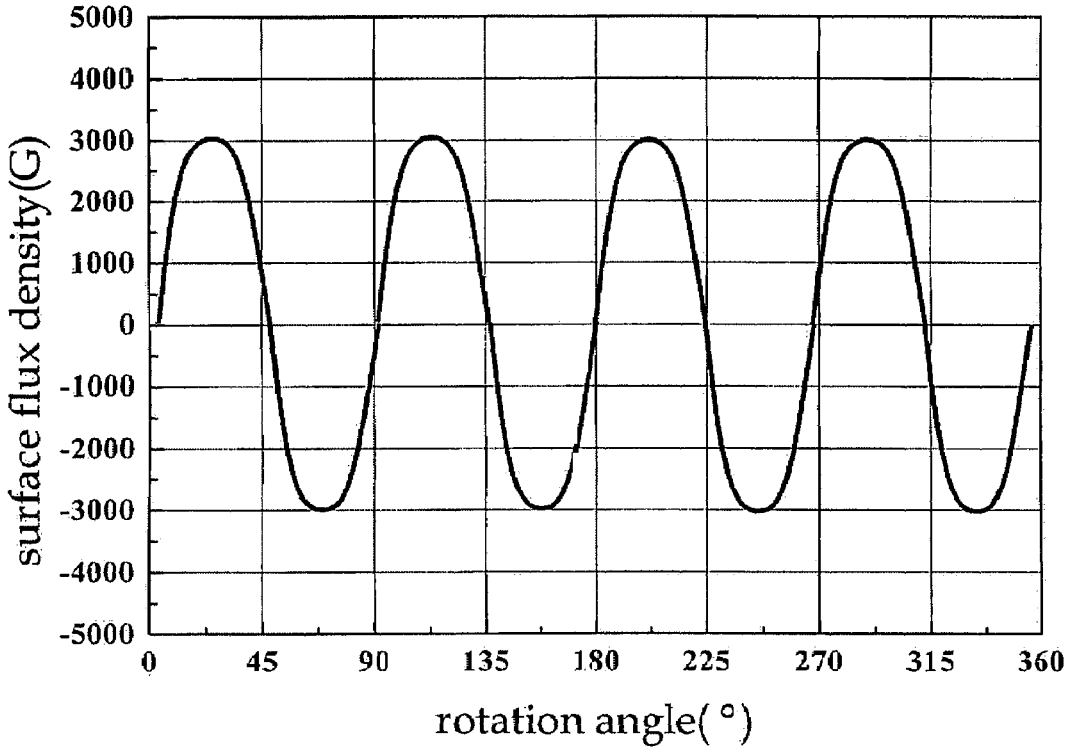
Fig. 2b Prior Art
FIG. 2*b* is a curve graph showing a surface flux density of the polar anisotropic hybrid magnet of FIG. 2*a;*

Hereinafter, a detailed description will be given of a method of manufacturing a laminated polar hybrid magnet, with reference to the appended drawings.

In the present invention, a specific description for the related techniques or structures (methods) is considered to be unnecessary, and thus, is omitted.

In particular, the appended drawings are mainly illustrated centering the contents related to the present invention, with the exception of parts known to those who skilled in the art. Additionally, in the drawings, expression difference for dimension ratios can be easily understood to those skilled in the art, and hence, a description therefor is omitted.

Further, it should be understood that the terminology used therein may be changed according to the intention or purpose of producers and manufacturers, and definition thereof is based on the description of the present invention.

Based on the present invention, first permanent magnet powders having relatively low magnetic properties are mixed with a thermoplastic resin and then extruded to prepare first compound pellets having low magnetic properties, and second permanent magnet powders having relatively high magnetic properties are mixed with a thermoplastic resin and then extruded to prepare second compound pellets having high magnetic properties. Thereafter, the first compound pellets are injection molded by use of a polar anisotropic and anisotropic mold having multi-poles and multi-cavities, to obtain a polar anisotropic and anisotropic resin magnet, which is then introduced into a polar anisotropic mold having an outer diameter larger than that of the polar anisotropic and anisotropic mold used for the first injection molding, and then secondly injection molded in a magnetic field, together with the second compound pellets. Thereby, a laminated polar anisotropic hybrid magnet having multi-poles and multi-layers can be obtained.

Hence, the laminated polar anisotropic hybrid magnet includes the polar anisotropic and anisotropic resin magnet having low magnetic properties at the inner part thereof, and the polar anisotropic magnet having high magnetic properties at the outer part thereof. As such, the first and second permanent magnet powders, which constitute the inner part and the outer part of the above hybrid magnet, respectively, have different temperature properties to each other.

The first permanent magnet powders having low magnetic properties are composed of any one type of powders selected from the group consisting of ferrite based powders (Ba-, Sr-, and Pb-based powders) and mixtures thereof, alnico powders, Fe—Cr—Co powders, SmCo powders, Sm—Fe—N powders, and Nd—Fe—B powders.

Further, the first permanent magnet powders may be used in combinations of two to four types of powders, selected from among the above listed powders.

On the other hand, the second permanent magnet powders having high magnetic properties have any one type of powders selected from the group consisting of SmCo powders, Sm—Fe—N powders, Nd—Fe—B powders, alnico powders, and Fe—Cr—Co powders.

Further, the second permanent magnet powders may be used in combinations of two to four types of powders, selected from among the above listed powders.

Furthermore, in the second permanent magnet powders, any one type of powders or combinations of two to four types of powders, selected from among the above listed powders, may be additionally mixed with the ferrite powders.

The laminated polar anisotropic hybrid magnet has 2 to 100 poles, an outer diameter of 5-500 mmΦ, and a height of 5-500 mm.

Also, the laminated polar anisotropic hybrid magnet includes two to four layers, with a thickness ratio of the laminated layers of 1:0.1-10.

Figure 3A:
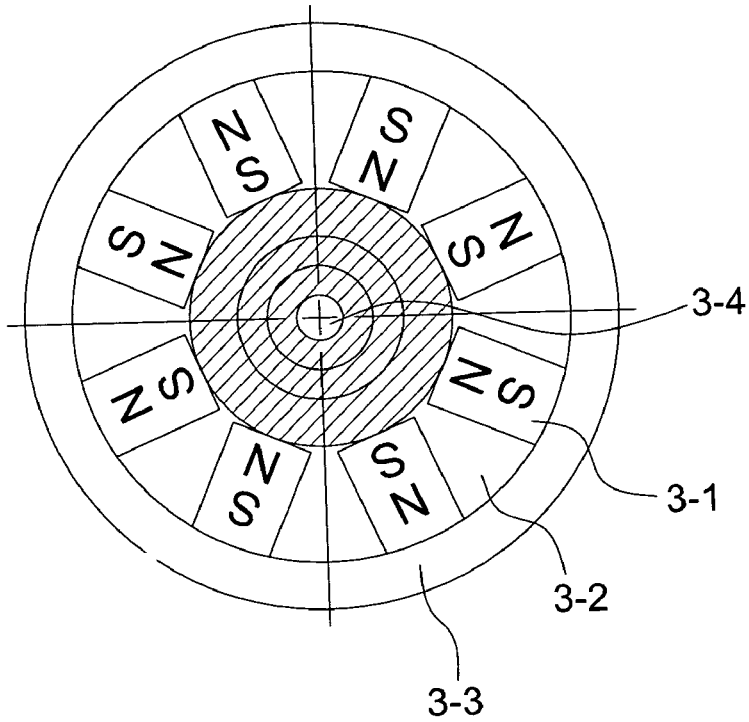
FIG. 3*a* is a view showing a polar anisotropic mold for use in preparation of a conventional polar anisotropic magnet.
Figure 3B:
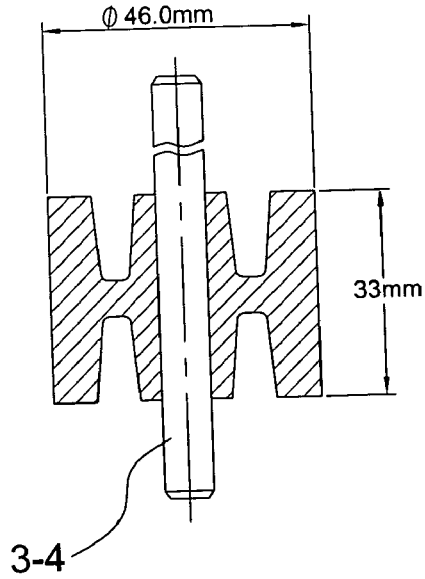
FIG. 3*b* is a sectional view of the polar anisotropic magnet prepared by use of the polar anisotropic mold of FIG. 3*a;*

According to a first embodiment of the present invention, first permanent magnet powders having low magnetic properties, such as ferrite (e.g.: Ba-, Sr- and Pb-based ferrite) powders and mixtures thereof, and alnico powders, are uniformly mixed with an amine coupling agent (e.g.: A-1120, purchased from Unikar, Japan) diluted with a nucleic acid, by use of a super mixer, and dried and then subjected to powder surface treatment. The coupling treated powders are uniformly blended with a thermoplastic resin (Nylon12; ZZ3000P, purchased from Degussa) and fatty acid amide (purchased from Nippon Kasei Chemical) for improvement of flowability, by use of a mixer, and then extruded at 150-300° C. in an atmosphere or inert gas by means of a twin screw extruder, to prepare first compound pellets. On the other hand, second compound pellets are prepared in the same procedure as above, with the exception that second permanent magnet powders having high magnetic properties, such as Sm—Co powders, HDDR-treated Nd—Fe—B powders, or Sm—Fe—N powders, are used. Thereafter, the first compound pellets are placed into an injection mold and then firstly injection molded, by use of an eight-pole anisotropic mold (FIG. 3*a*) having an outer diameter of 46 mmΦ and an inner diameter of 30 mmΦ which is applied with a magnetic field, under the injection conditions of a mold temperature of 70-110° C., an injection temperature of 210-300° C., and an injection pressure of 800-1500 kg/cm$^2$. Thereby, a polar anisotropic ferrite magnet is prepared (FIG. 3*b*).

Figure 4A:
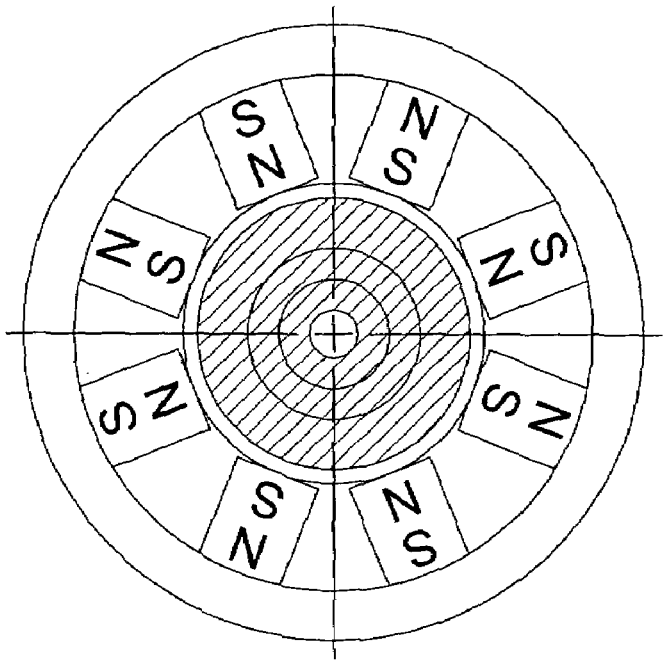
FIG. 4*a* is a view showing a polar anisotropic mold for use in preparation of a laminated polar anisotropic magnet, according to a first embodiment of the present invention.
Figure 4B:
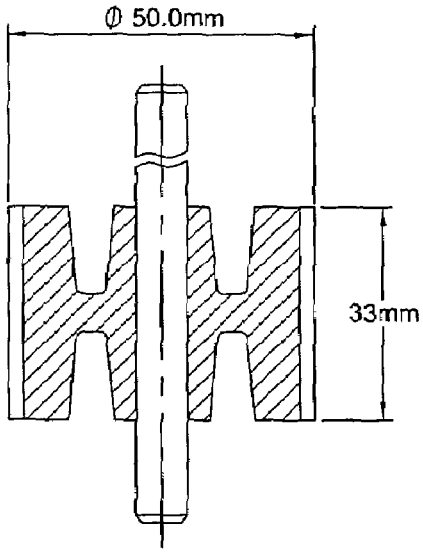
FIG. 4*b* is a sectional view of the laminated polar anisotropic magnet prepared by use of the polar anisotropic mold of FIG. 4*a;*

Subsequently, the polar anisotropic ferrite magnet is placed into a polar anisotropic mold (FIG. 4*a*) having an outer diameter of 50 mmΦ and an inner diameter of 30 mmΦ, and then secondly injection molded while being applied with a magnetic field under the injection conditions same as above, along with the second compound pellets, thus obtaining a laminated polar anisotropic hybrid magnet (FIG. 4*b*).

As for the manufacturing of the laminated polar anisotropic hybrid magnet of the present invention, the process of injection molding the compound pellets in a magnetic field is regarded to be important so as to increase a surface flux density by subjecting the magnet powders of the compound pellets oriented in a magnetic field direction to anisotropy. In the present invention, as shown in FIG. 3*a*, a permanent magnet 3-1 which acts to form the magnetic field required to maximize the orientation of the magnet powders is exemplified by an Nd-based rare earth sintered magnet of 39SH grade (residual flux density: 12.8 kg, coercive force: 21 kOe, maximum magnetic energy product: 39 MGOe), purchased from Smitomo Metal Industries, Japan. Further, a nonmagnetic spacer 3-2 is composed of stellite steel. An air gap between the above permanent magnet and the injected material decreases to 1 mmt, and a magnetically soft steel plate 3-3 is provided outside the permanent magnet for smooth flow of magnetic lines, resulting in the internally arranged magnetic field enhancement up to 6000 G. To improve the flowability of the injected material, not only injection temperatures but also the dimensions and shapes of a gate and a runner are adjusted.

Moreover, a shaft 3-4 is inserted into the injected material to manufacture an integrated rotor, whereby a core assembling process or a bonding process need not be additionally performed. A depth and an inner diameter of a H-shaped groove in the magnet are controlled, and thus, the laminated polar anisotropic hybrid magnet, according to the first embodiment of the present invention, is manufactured by use of minimal manufacturing costs.

Figure 5A:
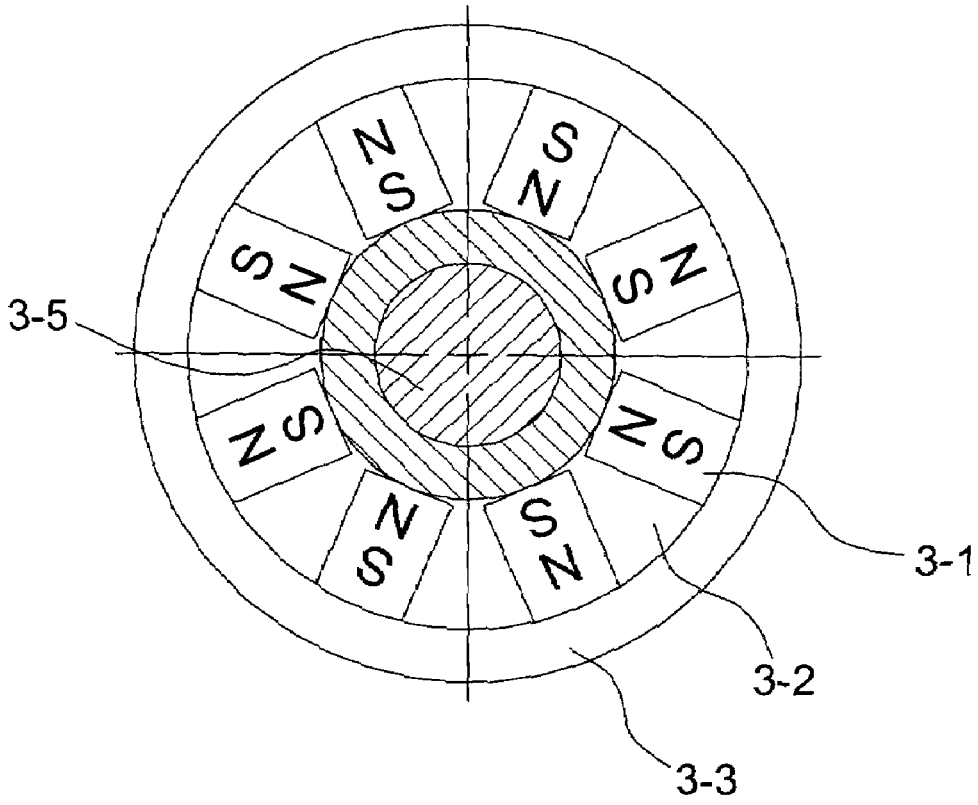
FIG. 5*a* is a view showing another polar anisotropic mold for use in preparation of a conventional polar anisotropic magnet.
Figure 5B:
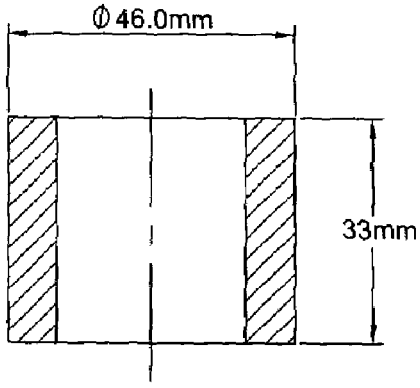
FIG. 5*b* is a sectional view of the polar anisotropic magnet prepared by use of the polar anisotropic mold of FIG. 5*a;*
Figure 6A:
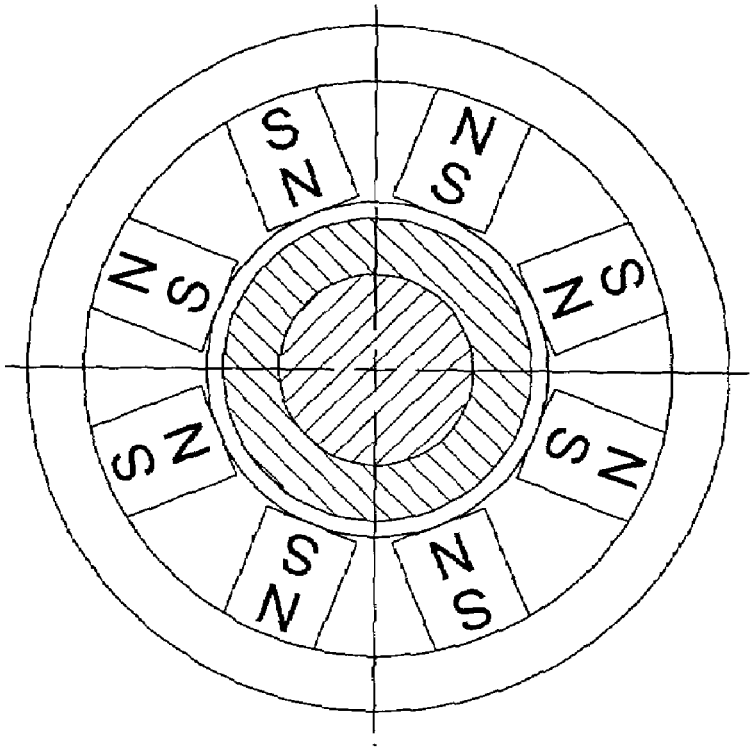
FIG. 6*a* is a view showing a polar anisotropic mold for use in preparation of a laminated polar anisotropic hybrid magnet, according to a second embodiment of the present invention.
Figure 6B:
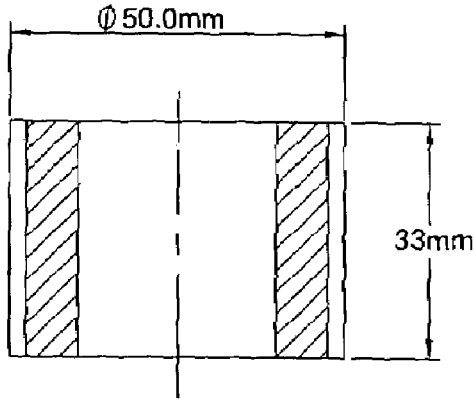
FIG. 6*b* is a sectional view of the laminated polar anisotropic hybrid magnet prepared by use of the polar anisotropic mold of FIG. 6*a;*

On the other hand, a rotor should have a proper weight to obtain higher inertia thereof. Hence, according to a second embodiment of the present invention, when an injection molding process in a magnetic field is performed by use of a mold having a core 3-5, as shown in FIGS. 5*a* and 6*a*, a hollow ring-type laminated polar anisotropic hybrid magnet may be obtained so that the core is inserted into the rotor, as in FIGS. 5*b* and 6*b*.

Figure 7A:
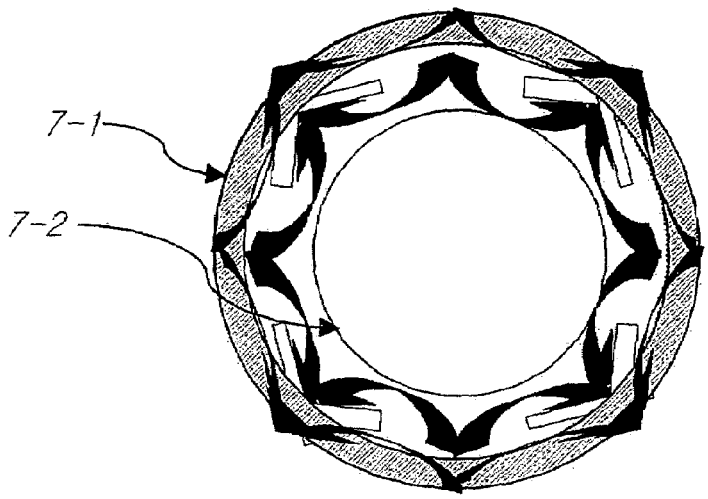
FIG. 7*a* is a view showing a magnetization direction of the laminated polar anisotropic hybrid magnet of the present invention.
Figure 7B:
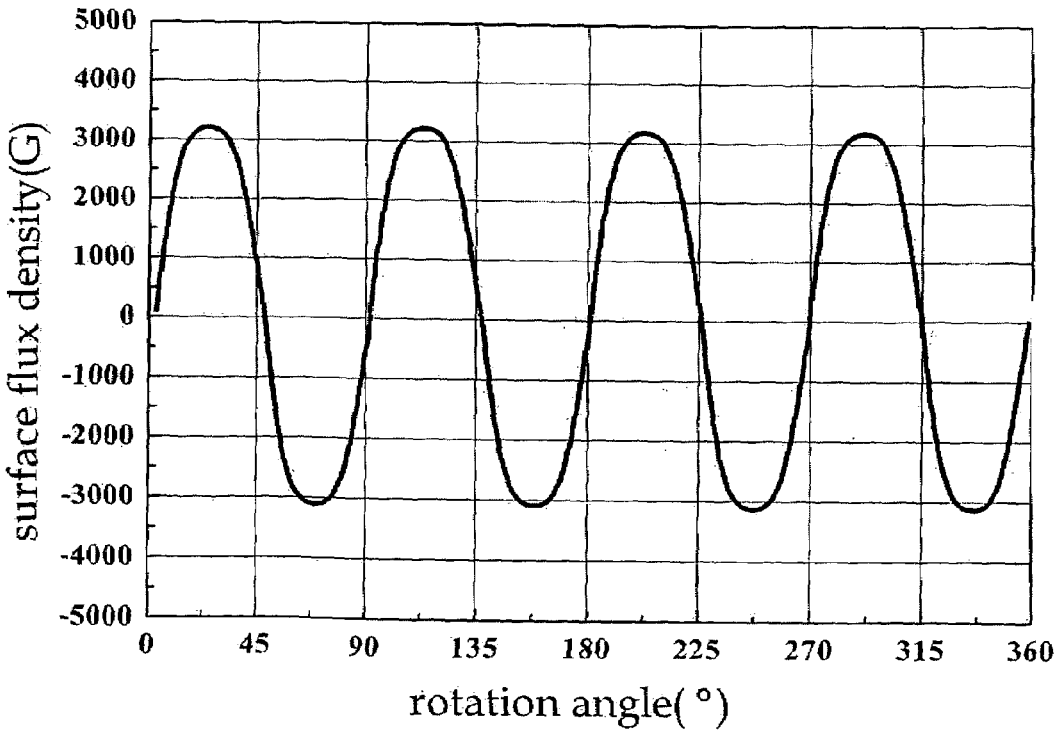
FIG. 7*b* is a curve graph showing a surface flux density of the laminated polar anisotropic hybrid magnet of FIG. 7*a;*

As illustrated in FIG. 7*a*, after the preparation of a polar anisotropic ferrite magnet 7-2 having an outer diameter of 46 mmΦ and an inner diameter of 30 mmΦ with a maximum surface flux density of 1700 G, an HDDR-treated Nd—Fe—B polar anisotropic magnet 7-1 having an outer diameter of 50 mmΦ and an inner diameter of 46 mmΦ is secondly injected in a layered manner. Thereby, the laminated polar anisotropic hybrid magnet having an outer diameter of 50 mmΦ and an inner diameter of 30 mmΦ, which has the maximum surface flux density improved to 3100 G, can be manufactured. In this case, the above result is confirmed from the curve graph of the surface flux density shown in FIG. 7*b*.

In the present invention, the laminated polar anisotropic hybrid magnet having an outer diameter of 50 mmΦ and an inner diameter of 30 mmΦ, and the polar anisotropic magnet having an outer diameter of 50 mmΦ and an inner diameter of 46 mmΦ by use of the HDDR-treated Nd—Fe—B, have the surface flux density of 3100 G (FIG. 7*b*) and 2180 G (Example 4), respectively. From this, it can be found that the magnetic properties of the laminated polar anisotropic hybrid magnet is higher by 40% or more compared to those of the polar anisotropic magnet.

The above two types of polar anisotropic magnets include the HDDR-treated Nd—Fe—B powders of the same weight. Though, to manufacture the laminated polar anisotropic hybrid magnet further having the ferrite magnet, although the ferrite powders are additionally purchased, the purchase price thereof corresponds to about 1/10 compared to that of the Nd—Fe—B powders. Thus, the total manufacturing costs of the above polar anisotropic magnets are similar.

Further, a polar anisotropic magnet with an outer diameter of 50 mmΦ and an inner diameter of 30 mmΦ, manufactured using HDDR-treated Nd—Fe—B powders, has a surface flux density of 4300 G (Example 3), which corresponds to the value higher by 35% than the laminated polar anisotropic hybrid magnet. However, the above polar anisotropic magnet has manufacturing costs four times that of the laminated polar anisotropic hybrid magnet, thus negating economic benefits. After all, it can be concluded that the laminated polar anisotropic hybrid magnet manufactured by layering two or more types of permanent magnet powders can generate economic benefits and further increase in magnetic properties, compared to the polar anisotropic magnets using one type of permanent magnet powders.

Used for the laminated polar anisotropic hybrid magnet, the ferrite magnet and the HDDR-treated Nd—Fe—B resin magnet have the residual flux density of 2.71 and 7.89 kG, respectively, and the maximum magnetic energy product of 1.85 and 12.97 MGOe, respectively. Conventionally, the above two types of powders are mixed together at a ratio of 50:50 vol % to prepare a compound, which is then injected in a magnetic field, to manufacture a hybrid magnet. On the other hand, in the present invention, the above two types of powders are separately used to prepare two types of compounds, which are then subjected to first and second injection in a magnetic field, to prepare a laminated polar anisotropic hybrid magnet having a powder volume ratio of 50:50 vol %. The resultant polar anisotropic hybrid magnet has a residual flux density of 4.75 kG and a maximum magnetic energy product of 5.02 MGOe, which are similar to those of the conventional hybrid magnet.

However, a driving force of a motor equipped with magnet increases in proportion to the length of the armature times the current flowing in the armature times the surface flux density of the magnet, based on the Fleming's left hand motor rule. Therefore, compared to the conventional hybrid magnet having two types of powders with different magnetic properties mixed together, the laminated hybrid magnet having the skin layer of the magnet having high magnetic properties and the inner layer of the magnet having low magnetic properties can further increase by about 20% in surface flux density.

That is, the laminated polar anisotropic hybrid magnet of the present invention can function to maximize the energies of the entire magnets used, because the magnet having higher magnetic properties is positioned at the outer part of the hybrid magnet that requires energy, and the magnet having low magnetic properties is positioned at the inner part thereof. In particular, when the powders constituting the outer and inner parts of the hybrid magnet have the same composition, the most preferable hybrid magnet can be manufactured.

Further, the laminated hybrid magnet having the skin layer having high magnetic properties and the inner layer having low magnetic properties has a higher surface flux density, when being compared to a conventional radial magnet having the same sizes and pole numbers manufactured by use of the same materials. In typical, since the radial magnet forms a surface flux density wave of a saw-toothed shape, it may cause a cogging phenomenon, due to the enhancement of a magnetic force with the silicon steel plate of the armature upon operation of the motor equipped with the above radial magnet. Meanwhile, the laminated polar anisotropic hybrid magnet of the present invention can form various surface flux density waves, by altering the types of the permanent magnet powders which constitute the skin layer and the inner layer thereof, or controlling the thickness of the skin layer having high magnetic properties. Thereby, motor designs become easy and motor efficiencies can increase.

Figure 8A:
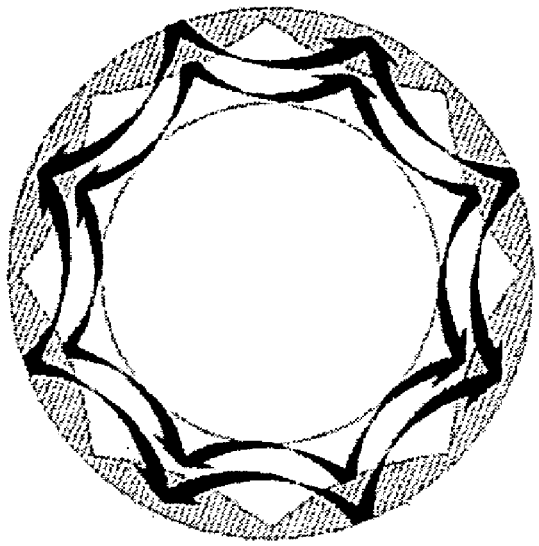
FIGS. 8*a* and 8*b* are views showing magnetization directions of laminated polar anisotropic hybrid magnets, according to third and fourth embodiments of the present invention, respectively.
Figure 8B:
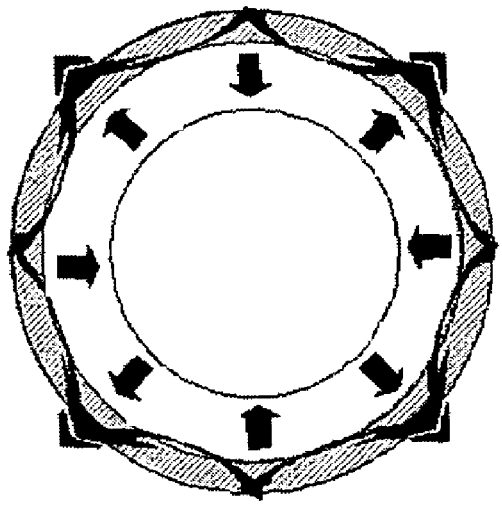

According to third and fourth embodiments of the present invention, with the aim of attaining higher magnetic properties of the magnet or economically manufacturing the magnet, the shapes of magnets of a skin layer and a inner layer of a laminated polar anisotropic hybrid magnet are changed, and thus, the magnetic circuit may be optimized, as shown in FIGS. 8*a* and 8*b*.

On the other hand, the rare earth magnet powders exhibiting high magnetic properties, such as HDDR-treated Nd—Fe—B powders, or Sm—Fe—N powders, have superior magnetic properties at room temperature. However, they drastically decrease in magnetic properties at high temperatures.

For example, as for a magnet manufactured by using HDDR-treated Nd—Fe—B powders, the coercive force, acting to determine the reliability for the performance of the magnet, decreases by about −0.45% according to the temperature increase of 1°. Thus, the magnetic force of the above magnet gradually decreases according to the temperature increase.

In contrast, a magnet using ferrite powders has rather an increased coercive force by 0.35-0.55%/° C. according to the temperature increase, hence exhibiting thermal stability.

Eventually, because the decrease of the coercive force of the rare earth magnet according to the temperature increase is compensated by the ferrite magnet, the laminated hybrid magnet is improved in thermal properties.

Having generally described this invention, a further understanding can be obtained by reference to certain specific examples which are provided herein for purposes of illustration only and are not intended to be limiting unless otherwise specified.

EXAMPLE 1

Each of Sr-ferrite powders (OP-71, available from Nippon Bengara), HDDR-treated Nd—Fe—B powders (MFC-15, available from Aichi), and Sm—Fe—N powders (available from SMM) was uniformly mixed with an amine coupling agent, A-1120, (available from Unikar, Japan) diluted with nucleic acid, by use of a super mixer, and dried and then subjected to powder surface treatment. The respective surface treated powders were kneaded with Nylon 12 (ZZ3000P, available from Degussa) as a thermoplastic resin, and fatty acid amide (available from Nippon Kasei Chemical) serving to increase flowability, according to a mixing ratio shown in the following Table 1, and then extruded at 210-260° C. in an atmosphere or inert gas by use of a twin screw extruder, to prepare three types of compound pellets. The respective compound pellets were introduced into an injection molding machine, and then injected in a height direction relative to a mold which was applied with a magnetic field and had an outer diameter of 30 mmΦ and a height of 5 mmt, under the injection conditions of a mold temperature of 80° C., an injection temperature of 220-270° C. and an injection pressure of 900-1500 kg/cm$^2$, to prepare each isotropic resin magnet.

The anisotropic resin magnet, which was magnetized with a magnetic field of 30 kOe, was measured for M-H curves while a magnetic field of 20 kOe was applied thereto, by use of a BH tracer. The results are shown in Table 1, below.

TABLE 1

Magnetic properties Of Anisotropic Resin Magnet

| No. | Permanent Magnet Powders | Coercive Force Change (%/° C.) | Residual Flux Density (kG) | Coercive Force (kOe) | Max. Energy Product (MGOe) |
|---|---|---|---|---|---|
| 1 | OP-71 (89 wt %) + Nylon12 (11 wt %)* | 0.45 | 2.71 | 3.34 | 1.85 |
| 2 | MFC-15 (93 wt %) + Nylon12 (7 wt %)* | −0.45 | 7.89 | 11.94 | 12.97 |
| 3 | Sm-Fe-N (92 wt %) + Nylon12 (8 wt %)* | −0.4 | 7.20 | 7.17 | 11.68 |
| 4 | Com. 1(50 vol %) + Com. 2(50 vol %) | −0.06 | 4.75 | 8.40 | 5.02 |
| 5 | Com. 1(50 vol %) + Com. 3(50 vol %) | −0.04 | 4.68 | 5.24 | 5.12 |
| 6 | Com. 2(50 vol %) + Com. 3(50 vol %) | −0.42 | 7.45 | 8.90 | 12.06 |

*Nylon + additives

EXAMPLE 2

Sr-ferrite powders were admixed with 0.5 wt % of A-1120 an amine coupling agent diluted with nucleic acid, based on the above powders, by use of a super mixer, and then subjected to powder surface treatment. The coupling treated powders, Nylon 12 as a thermoplastic resin, and fatty acid amide were weighed at a weight ratio of 89.5:10.3:0.2 wt %, and then uniformly mixed by use of a mixer.

Subsequently, the mixture was extruded at 240° C. using a twin screw extruder, to prepare compound pellets, which were then introduced into an injection molding machine, followed by injection molding in a magnetic field by use of an eight-pole anisotropic mold having an outer diameter of 50 mmΦ, an inner diameter of 30 mmΦ and a height of 33 mmt, under the injection conditions of a mold temperature of 80° C., an injection temperature of 260° C. and an injection pressure of 1000 kg/cm$^2$, to manufacture a polar anisotropic magnet.

In particular, the process of injecting the compound pellets in a magnetic field was applied to increase a surface flux density by subjecting the magnet powders of the compound pellets oriented in a magnetic field direction to anisotropy. As shown in FIG. 3*a*, a permanent magnet 3-1, serving to form the magnetic field required to maximize the orientation of the powders, was exemplified by an Nd-based rare earth sintered magnet of 39SH grade (residual flux density: 12.8 kg, coercive force: 21 kOe, maximum magnetic energy product: 39 MGOe), purchased from Smitomo Metal Industries, Japan. Further, a nonmagnetic spacer 3-2 was composed of stellite steel, and an air gap between the above permanent magnet and the injected material decreased to 1 mmt. Furthermore, a magnetically soft steel plate (3-3) was disposed outside the permanent magnet to be suitable for flow of magnetic lines, resulting in the internally arranged magnetic field enhancement up to 6000 G. Improvement of flowability of the injected material resulted from control of injection temperatures, as well as dimensions and shapes of a gate and a runner.

The polar anisotropic magnet, which was magnetized with a magnetic field of 20 kOe, was measured for a surface flux density while it was rotated in an outer diameter direction thereof, by means of a gauss meter. The results are shown in Table 2, below.

TABLE 2

| Magnet Size | Pole | Powder | Max. Surface Flux Density |
|---|---|---|---|
| Outer Diameter 50 mmΦ<br>Inner Diameter 30 mmΦ<br>Height 33 mmt | 8 | Ferrite (183 g) | 1800 G |

Figure 9:
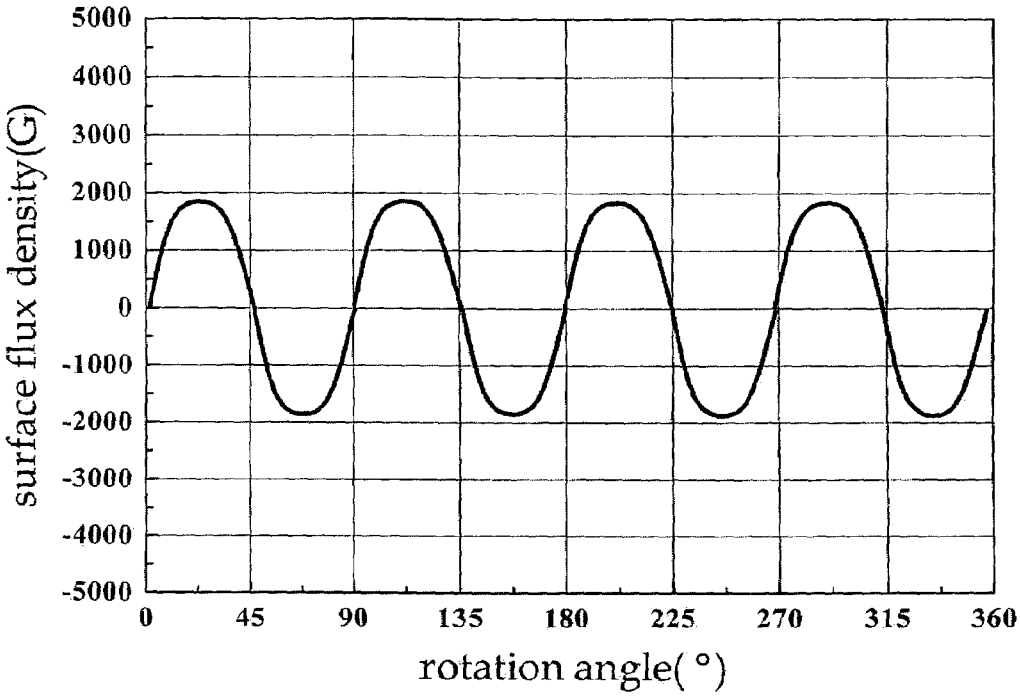
FIGS. 9 to 13 are curve graphs showing surface flux densities of polar anisotropic magnets prepared in Examples 2 to 6 of the present invention.

A curve graph of the surface flux density of the polar anisotropic magnet is illustrated in FIG. 9.

EXAMPLE 3

93.3 wt % of the HDDR-treated Nd—Fe—B powders, coupling treated in the same manner as in Example 2, was uniformly mixed with 6.4 wt % of Nylon 12 and 0.3 wt % of fatty acid amide and then extruded at 230° C. by use of a twin screw extruder, to prepare compound pellets. Thereafter, the compound pellets were introduced into an injection molding machine, and injected in a magnetic field by use of an eight-pole anisotropic mold having an outer diameter of 50 mmΦ, an inner diameter of 30 mmΦ and a height of 33 mmt, under the injection conditions of a mold temperature of 80° C., an injection temperature of 250° C. and an injection pressure of 900 kg/cm$^2$, to manufacture a polar anisotropic magnet.

As such, the used anisotropic mold had the structure same as in Example 2 (FIG. 4*a*).

The polar anisotropic magnet, which was magnetized with a magnetic field of 20 kOe, was measured for a surface flux density while it was rotated in an outer diameter direction thereof, by means of a gauss meter. The results are shown in Table 3, below.

TABLE 3

| Magnet Size | Pole | Powder | Max. Surface Flux Density |
|---|---|---|---|
| Outer Diameter 50 mmΦ<br>Inner Diameter 30 mmΦ<br>Height 33 mmt | 8 | Nd—Fe—B Powder (250 g) | 4300 G |

Figure 10:
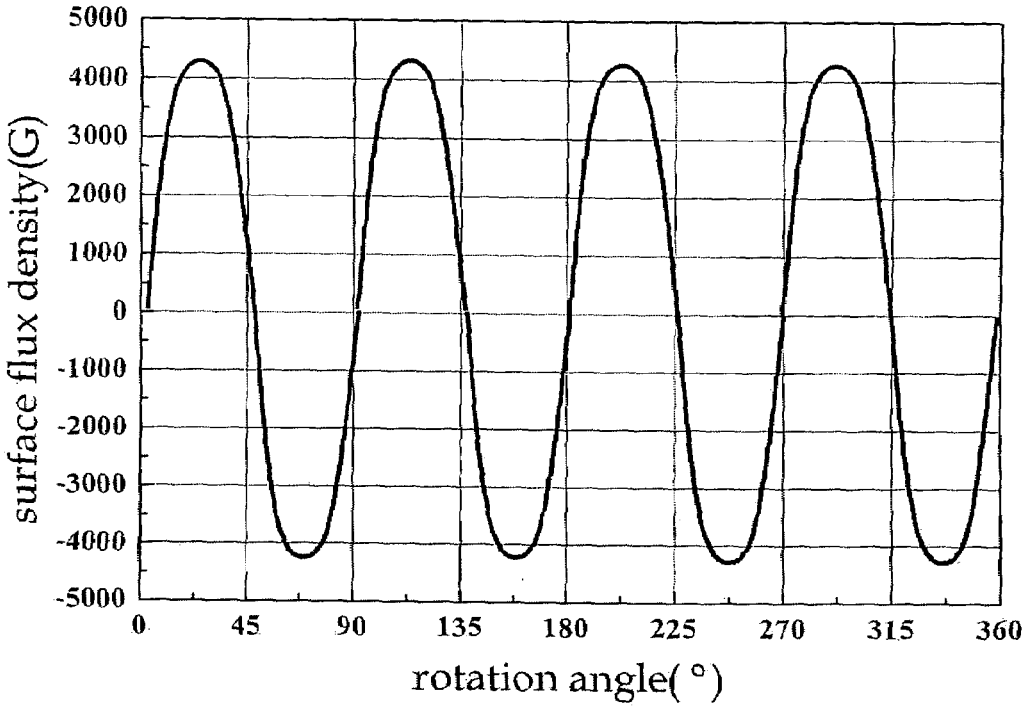

A curve graph of the surface flux density of the polar anisotropic magnet is illustrated in FIG. 10.

EXAMPLE 4

The compound pellets prepared in Example 3 were injected in a magnetic field under the injection conditions same as in Example 3, by use of an eight-pole anisotropic mold with an outer diameter of 50 mmΦ, an inner diameter of 46 mmΦ and a height of 33 mmt, to manufacture a polar anisotropic magnet.

As such, the used anisotropic mold had the structure the same as in Example 2 (FIG. 4*a*).

The polar anisotropic magnet, which was magnetized with 20 kOe, was measured for a surface flux density while it was rotated in an outer diameter direction thereof, using a gauss meter. The results are shown in Table 4, below.

TABLE 4

| Magnet Size | Pole | Powder | Max. Surface Flux Density |
|---|---|---|---|
| Outer Diameter 50 mmΦ<br>Inner Diameter 46 mmΦ<br>Height 30 mmt | 8 | Nd—Fe—B Powder (47 g) | 2180 G |

Figure 11:
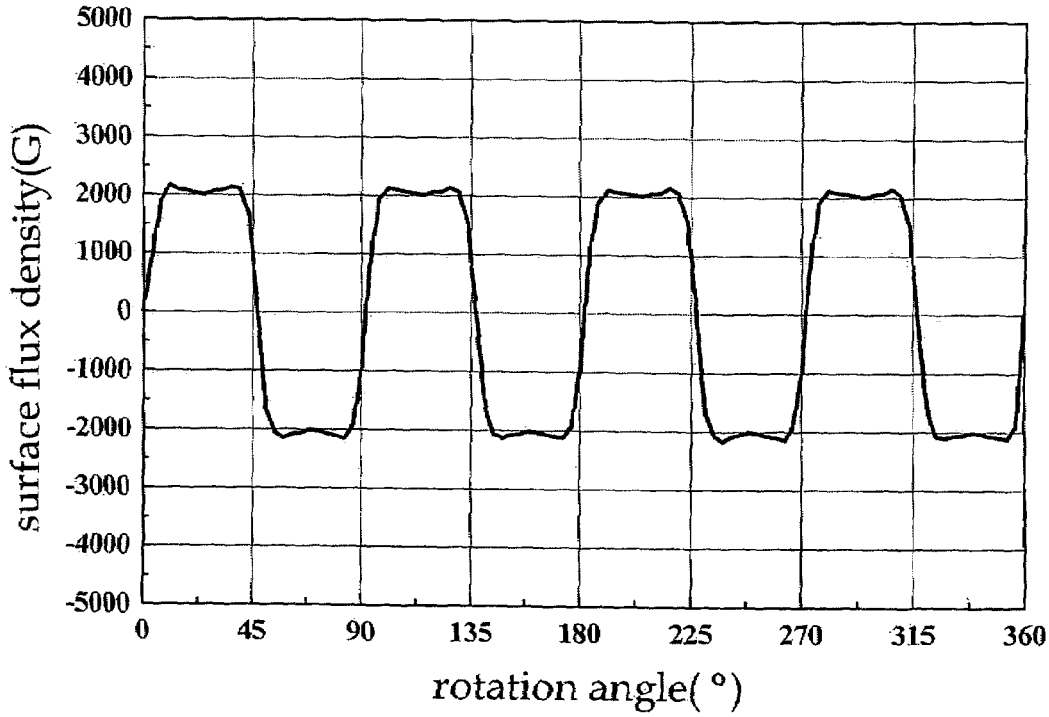

A curve graph of the surface flux density of the polar anisotropic magnet is illustrated in FIG. 11.

EXAMPLE 5

Each of the compound pellets prepared in Examples 2 and 3, which was weighed at a volume ratio of 50:50 vol %, was uniformly mixed, and then introduced into an injection molding machine, followed by injection molding in a magnetic field by use of an eight-pole anisotropic mold with an outer diameter of 50 mmΦ, an inner diameter of 30 mmΦ and a height of 33 mmt, under the injection conditions of a mold temperature of 80° C., an injection temperature of 245° C. and an injection pressure of 960 kg/cm$^2$, to manufacture a polar anisotropic hybrid magnet.

As such, the used anisotropic mold had the structure the same as in Example 2 (FIG. 4*a*).

The polar anisotropic hybrid magnet, which was magnetized with 20 kOe, was measured for a surface flux density while it was rotated in an outer diameter direction thereof, using a gauss meter. The results are shown in Table 5, below.

TABLE 5

| Magnet Size | Pole | Powder | Max. Surface Flux Density |
|---|---|---|---|
| Outer Diameter 50 mmΦ<br>Inner Diameter 30 mmΦ<br>Height 33 mmt | 8 | Nd—Fe—B Powder (125 g) + Ferrite (92 g) | 3050 G |

Figure 12:
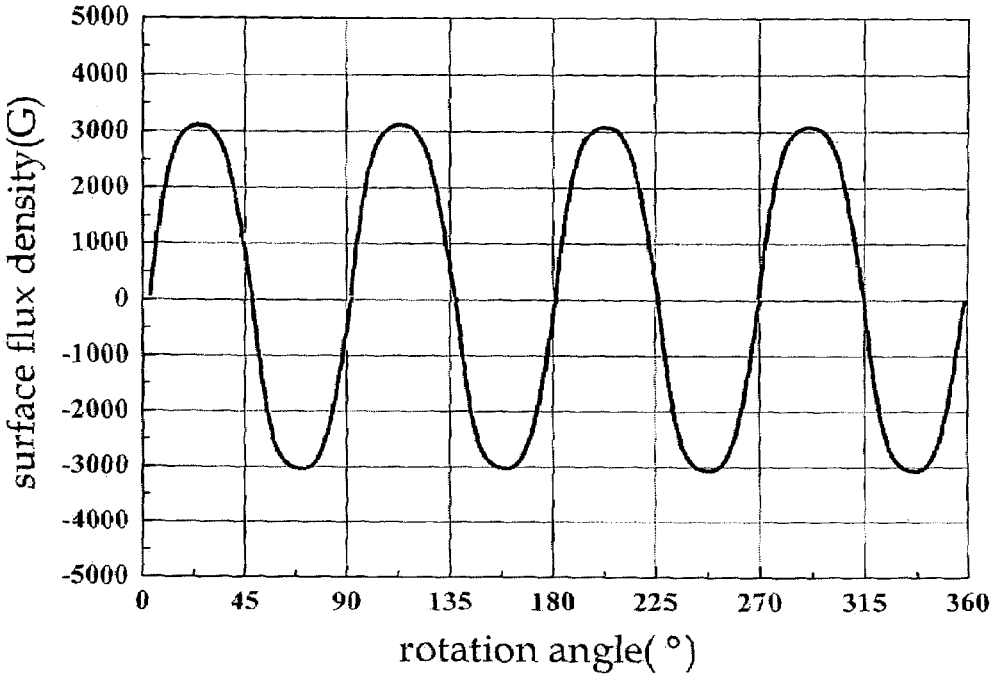

A curve graph of the surface flux density of the polar anisotropic hybrid magnet is illustrated in FIG. 12.

EXAMPLE 6

The compound pellets prepared in Example 2 were firstly injected in a magnetic field by use of an eight-pole anisotropic mold with an outer diameter of 46 mmΦ, an inner diameter of 30 mmΦ and a height of 33 mmt, under the injection conditions same as in Example 2, to manufacture a polar anisotropic ferrite magnet. Subsequently, the ferrite magnet was charged into a polar anisotropic mold with an outer diameter of 50 mmΦ, an inner diameter of 30 mmΦ and a height of 33 mmt, and was secondly injected along with the compound pellets prepared in Example 3, under the injection conditions same as in Example 3, to manufacture a laminated polar anisotropic hybrid magnet.

The laminated polar anisotropic hybrid magnet, which was magnetized with 20 kOe, was measured for a surface flux density while it was rotated in an outer diameter direction thereof, by means of a gauss meter. The results are shown in Table 6, below.

TABLE 6

| Magnet Size | Pole | Powder | Max. Surface Flux Density |
|---|---|---|---|
| Outer Diameter 50 mmΦ<br>Inner Diameter 30 mmΦ<br>Height 33 mmt | 8 | Nd—Fe—B Powder (47 g) + Ferrite (149 g) | 3100 G |

Figure 13:
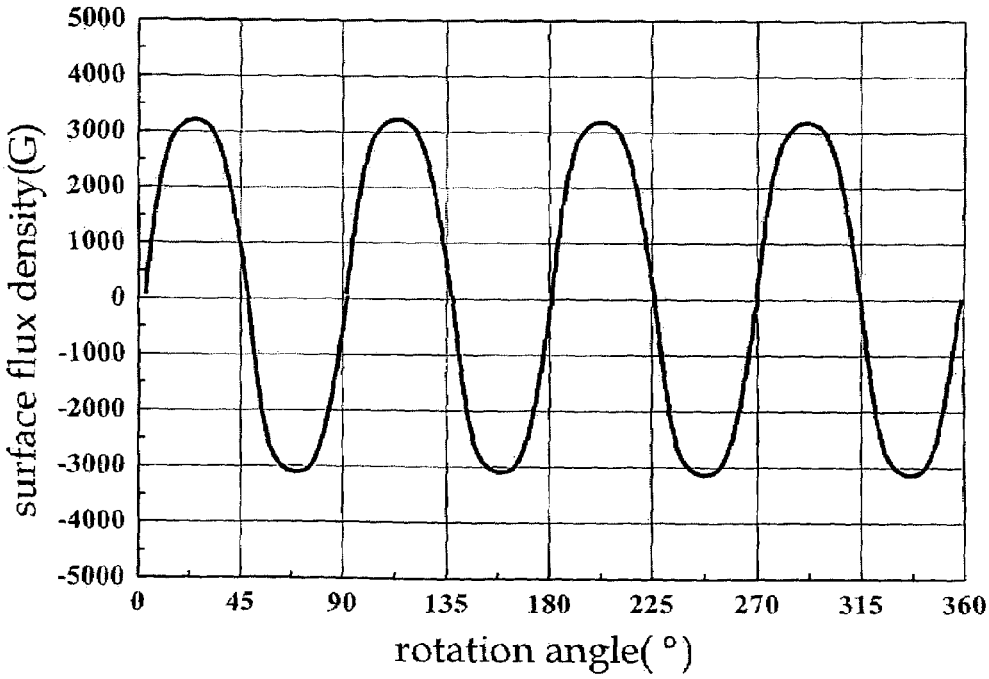

A curve graph of the surface flux density of the laminated polar anisotropic hybrid magnet is illustrated in FIG. 13.

EXAMPLE 7

The compound pellets prepared in Examples 2 and 3 were injected in a magnetic field in a height direction relative to a mold having an outer diameter of 50 mmΦ and a height of 5 mmt, under the injection conditions same as in Examples 2 and 3, to manufacture an anisotropic resin magnet.

Figure 14:
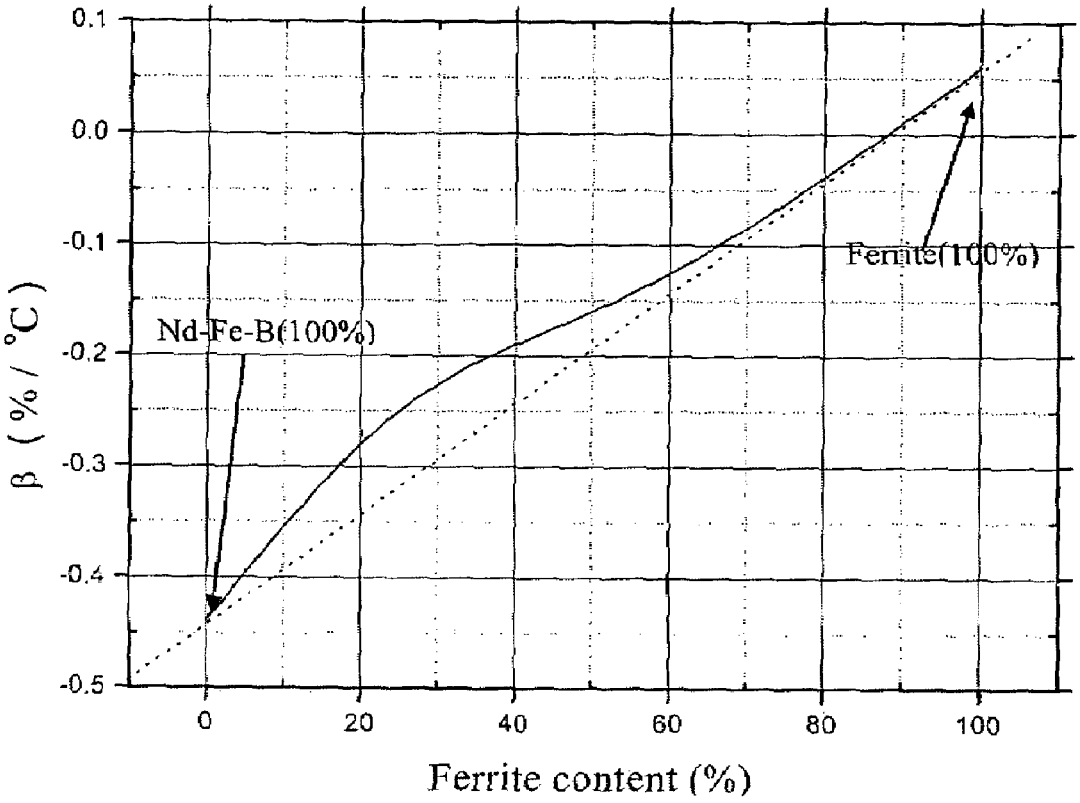
FIG. 14 is a graph showing the change of coercive force of an anisotropic resin magnet prepared in Example 7 of the present invention.

Referring to FIG. 14, there is shown the change of the coercive force in the range of room temperature to 120° C. while the anisotropic resin magnet magnetized with 30 kOe is applied with the magnetic field of 20 kOe, by use of a BH tracer.

In the above drawing, β on a vertical axis shows the reduction rate (%/° C.) of the coercive force according to the change of the temperature.

In the present invention, the laminated polar anisotropic hybrid magnet is applied for high-powered motor products, such as VCRs, laser printers, hard disk drives (HDD), robots, electric power steering, automobile fuel pumps, washing machines, refrigerators, air conditioners, etc. As such, higher magnetic properties of the permanent magnet can be realized, and therefore, motor design technique can be variously changed and applications of the magnet become wider. As well, small sizes of end products can be achieved, resulting in reduced manufacturing costs thereof.

Further, the energy consumption may decrease by using the motor with high efficiency. Thus, research into the development of the permanent magnet material having high energy product can be further promoted. Moreover, even though the same permanent magnet material is used, the surface flux density of the magnet can be maximized by reason of optimization of a magnetic circuit design.

As described hereinbefore, the prevent invention provides a method of manufacturing a laminated polar anisotropic hybrid magnet, as a ring-type anisotropic bonded magnet applicable for high-powered motors and actuators, characterized by obtaining higher magnetic properties, and reducing the use of expensive magnet materials, thus generating economic benefits. Further, a flux density wave of the magnet can be easily controlled on the magnet surface to be suitable for performances and characteristics of the motors, and temperature properties of the magnet can be enhanced. Thereby, the entire manufacturing method of the magnet can be efficiently carried out, therefore increasing productivity and reliability in practical use thereof.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of manufacturing a laminated polar anisotropic hybrid magnet, comprising:

mixing at least one first permanent magnet powder having first magnetic properties with a thermoplastic resin to prepare first compound pellets having magnetic properties, and mixing at least one second permanent magnet powder having magnetic properties which are higher than said first magnetic properties with a thermoplastic resin to prepare second compound pellets having high magnetic properties which are higher than said magnetic properties of said first compound pellets;

injection molding the first compound pellets by use of a first polar anisotropic and anisotropic mold having multi-poles and multi-cavities, to prepare a polar anisotropic and anisotropic resin magnet; and placing the polar anisotropic and anisotropic resin magnet into a second polar anisotropic mold having an outer diameter larger than that of said first polar anisotropic and anisotropic mold used for the firstly injection molding, thereby leaving a space between said polar anisotropic and anisotropic resin magnet and said second mold, injection molding in a magnetic field the second compound pellets into said space to manufacture a laminated polar anisotropic hybrid magnet with multi-poles and multi-layers.

2. A method according to claim 1 wherein the laminated polar anisotropic hybrid magnet comprises the polar anisotropic and anisotropic resin magnet having first magnetic properties at an inner part of the laminated polar anisotropic hybrid magnet and the polar anisotropic resin magnet having higher magnetic properties at an outer part thereof, provided that the first and second permanent magnet powders constituting the inner and outer parts thereof, respectively, have different temperature properties relative to each other.

3. A method according to claim 1 wherein the at least one first permanent magnet powder comprises at least one powder selected from the group consisting of ferrite (Ba, Sr and Pb) powders and mixtures thereof, alnico powders, Fe—Cr—Co powders, SmCo powders, Sm—Fe—N powders, Nd—Fe—B powders, and mixtures thereof.

4. A method according to claim 3 wherein the at least one first permanent magnet powder comprises combinations of two to four types of the powders selected from among the above listed powders.

5. A method according to claim 1 wherein the at least one second permanent magnet powder comprises any one type of powders selected from the group consisting of SmCo powders, Sm—Fe—N powders, Nd—Fe—B powders, alnicopowders, Fe—Cr—Co powders, and mixtures thereof.

6. A method according to claim 5 wherein the at least one second permanent magnet powder comprises combinations of two to four types of the powders selected from among the above listed powders.

7. A method according to claim 5 wherein the at least one second permanent magnet powder comprises any one type of the powders or combinations of two to four types of the powders selected from among the above listed powders, mixed with ferrite powders.

8. A method according to claim 1 wherein the laminated polar anisotropic hybrid magnet comprises 2 to 100 poles, an outer diameter of 5 to 500 mmΦ, and a height of 5 to 500 mm.

9. A method according to claim 1 wherein the laminated polar anisotropic hybrid magnet comprises 2 to 4 layers, and a thickness ratio of laminated layers of 1:0.1-10.

10. A method according to claim 2 wherein the at least one first permanent magnet powder comprises at least one powder selected from the group consisting of ferrite (Ba, Sr and Pb) powders and mixtures thereof, alnico powders, Fe—Cr—Co powders, SmCo powders, Sm—Fe—N powders, and Nd—Fe—B powders, and mixtures thereof.

11. A method according to claim 2 wherein the at least one second permanent magnet powder comprises at least one powder selected from the group consisting of SmCo powders, Sm—Fe—N powders, Nd—Fe—B powders, alnicopowders, Fe—Cr—Co powders, and mixtures thereof.

12. A method according to claim 2 wherein the laminated polar anisotropic hybrid magnet comprises 2 to 100 poles, an outer diameter of 5 to 500 mmΦ, and a height of 5 to 500 mm.

13. A method according to claim 2 wherein the laminated polar anisotropic hybrid magnet comprises 2 to 4 layers, and a thickness ratio of laminated layers of 1:0.1-10.

* * * * *